US009150376B2

(12) United States Patent
Takahashi et al.

(10) Patent No.: US 9,150,376 B2
(45) Date of Patent: Oct. 6, 2015

(54) IMAGE FORMING APPARATUS CAPABLE OF FORMING IMAGES IN DOUBLE-SIDED MODE

(71) Applicant: CANON KABUSHIKI KAISHA, Tokyo (JP)

(72) Inventors: Keita Takahashi, Abiko (JP); Hidenori Matsumoto, Kashiwa (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/327,994

(22) Filed: Jul. 10, 2014

(65) Prior Publication Data

US 2015/0014915 A1 Jan. 15, 2015

(30) Foreign Application Priority Data

Jul. 12, 2013 (JP) ..... 2013-146414

(51) Int. Cl.

| | |
|---|---|
| ***B65H 15/00*** | (2006.01) |
| ***B65H 29/58*** | (2006.01) |
| ***B65H 85/00*** | (2006.01) |
| ***B65H 43/00*** | (2006.01) |

(52) U.S. Cl.

CPC ..... *B65H 29/58* (2013.01); *B65H 15/00* (2013.01); *B65H 43/00* (2013.01); *B65H 85/00* (2013.01); *B65H 2511/11* (2013.01)

(58) Field of Classification Search

CPC ..... B65H 85/00; B65H 29/58; B65H 15/00; B65H 2511/11

USPC ..... 271/265.01, 302, 303, 298, 225

See application file for complete search history.

(56) References Cited

U.S. PATENT DOCUMENTS

| | | | | |
|---|---|---|---|---|
| 5,689,759 | A | 11/1997 | Isemura et al. | |
| 7,033,014 | B2 * | 4/2006 | Ohashi et al. | 347/104 |
| 8,444,135 | B2 * | 5/2013 | Morita et al. | 271/3.17 |
| 8,632,070 | B2 * | 1/2014 | Nonaka | 271/265.01 |
| 2008/0143044 | A1 * | 6/2008 | Hatano | 271/225 |
| 2010/0315475 | A1 * | 12/2010 | Taki et al. | 347/179 |
| 2011/0180988 | A1 * | 7/2011 | Muratani et al. | 271/225 |
| 2012/0025454 | A1 * | 2/2012 | Iguchi et al. | 271/225 |

FOREIGN PATENT DOCUMENTS

| | | | | |
|---|---|---|---|---|
| JP | 01281250 A | * | 11/1989 | B65H 29/58 |
| JP | 07-330228 A | | 12/1995 | |

* cited by examiner

*Primary Examiner* — Patrick Cicchino

(74) *Attorney, Agent, or Firm* — Rossi, Kimms & McDowell LLP

(57) ABSTRACT

An image forming apparatus which enables double-sided image formation using a sheet feeding unit, and is capable of discharging a sheet, whose sheet length is undetermined by the time the sheet reaches a branch area in conveyance for double-sided image formation, without guiding it to a sheet inverting unit. A conveying flapper switches a destination for a sheet to a first conveying path leading to a sheet inverting unit or a second conveying path leading to a sheet discharge tray. A length of a sheet in a conveying direction is detected while the sheet is being conveyed. When a size of the sheet is undetermined, and the length of the sheet is not detected by the time the sheet reaches the conveying flapper, the conveying flapper is controlled so as to convey the sheet with an image formed on a first side thereof to the second conveying path.

8 Claims, 14 Drawing Sheets

FIG. 5

| SHEET TYPE | SHEET LENGTH (mm) | WHETHER TO EXECUTE DOUBLE-SIDED MODE |
|---|---|---|
| A3-SIZE SHEET | 420 | ○ |
| A4-SIZE SHEET LONG EDGE FEED | 210 | ○ |
| A4-SIZE SHEET SHORT EDGE FEED | 297 | ○ |
| A5-SIZE SHEET LONG EDGE FEED | 148 | × |
| A5-SIZE SHEET SHORT EDGE FEED | 210 | ○ |
| JIS B4-SIZE SHEET | 364 | ○ |
| JIS B5-SIZE SHEET LONG EDGE FEED | 182 | ○ |
| JIS B5-SIZE SHEET SHORT EDGE FEED | 257 | ○ |
| POSTAL CARD LONG EDGE FEED | 100 | × |
| POSTAL CARD SHORT EDGE FEED | 148 | × |
| REPLY-PAID POSTAL CARD LONG EDGE FEED | 148 | × |
| REPLY-PAID POSTAL CARD SHORT EDGE FEED | 200 | ○ |
| C5-SIZE ENVELOPE | 229 | ○ |
| NO. 4 WESTERN-STYLE ENVELOPE LONG EDGE FEED | 105 | × |
| NO. 4 WESTERN-STYLE ENVELOPE SHORT EDGE FEED | 235 | ○ |
| NO. 2 JAPANESE-STYLE ENVELOPE | 332 | ○ |
| NO. 2 WESTERN-STYLE ENVELOPE LONG EDGE FEED | 114 | × |
| NO. 2 WESTERN-STYLE ENVELOPE SHORT EDGE FEED | 162 | × |
| FOUR-SHEET POSTAL CARD | 200 | ○ |
| FOUR-SHEET POSTAL CARD | 296 | ○ |
| LDR | 431.8 | ○ |
| LTR | 215.9 | ○ |
| 12×18 | 457.2 | ○ |
| 17×22 | 558.8 | × |
| 18×24 | 609.6 | × |
| 13×19 | 482.6 | × |

IMAGE FORMING APPARATUS CAPABLE OF FORMING IMAGES IN DOUBLE-SIDED MODE

BACKGROUND OF THE INVENTION

1. Field of the Invention

The present invention relates to an image forming apparatus which is capable of forming images in a double-sided mode.

2. Description of the Related Art

Conventionally, there have been image forming apparatuses such as copiers, printers, and facsimile machines, which have not only sheet feeding cassettes in which regular-size sheets are housed, but also, for example, a manual feed tray as a sheet feeding unit from which sheets of various irregular sizes (sizes that are not regular) can be fed. Some of such image forming apparatuses are able to detect a length of a sheet, which is placed on the manual feed tray, in a width direction (direction perpendicular to a conveying direction).

As described in U.S. Pat. No. 5,689,759, there is known an apparatus which, based on information on a sheet width obtained by width detection on a manual feed tray, displays prospective regular sizes on an operation unit and prompts a user to select a sheet size.

As described in Japanese Laid-Open Patent Publication (Kokai) No. H07-33G228, there is also known an apparatus which, based on an output from a sensor on a sheet conveying path in a case where a sheet with unknown size is conveyed from the manual feed tray, determines a sheet length of a sheet, which is fed from a manual feed tray, in a conveying direction and controls a bring-in gate of an intermediate tray in accordance with the sheet length.

In general, when double-sided image formation is to be carried out in an image forming apparatus, there may be sheets which can properly pass a double-sided path, on which a sheet with an image formed on a first side (front side) thereof is conveyed, and sheets which cannot properly pass the double-sided path. For example, when a sheet length in a conveying direction is shorter than a distance between sheet conveying rollers placed on the double-sided path, a sheet cannot be delivered between the sheet conveying rollers, and the sheet cannot pass the double-sided path. When such a sheet whose sheet length is too short is used, an automatic double-sided mode cannot be executed.

In an apparatus which has an inversion path for inverting a sheet when conveying it to a double-sided path, a sheet whose sheet length in a conveying direction is longer than a length of the inversion path cannot be inverted. Thus, when a sheet whose sheet length is too long, an automatic double-sided mode cannot be executed.

If the number of conveying rollers on a conveying path is increased to make distances between them short, or an inversion path is configured to be long in order to solve the problems described above, this will increase the cost and size of an image forming apparatus. In view of the circumstances, in many conventional models, an automatic double-sided mode is disabled in a non-specified size mode in which a sheet is fed from a manual feed tray with a sheet length in a conveying direction undermined.

However, even in a case where a sheet placed on a manual feed tray is a general regular-size sheet such as an A4- or B4-size sheet when image formation is to be performed in the non-specified size mode, usability will be significantly compromised if an automatic double-sided mode is disabled across the board. Moreover, in a case where a double-sided mode is enabled in the non-specified size mode in the apparatus described in Japanese Laid-Open Patent Publication (Kokai) No. H07-330228, when it is determined that a sheet has such a length that the sheet cannot be conveyed, there is no other choice but to dealt with this as a sheet jam, causing an increase in downtime of the image forming apparatus.

SUMMARY OF THE INVENTION

The present invention provides an image forming apparatus, which enable double-sided image formation using a sheet feeding unit from which irregular-size sheets can be fed, and is capable of discharging a sheet, whose sheet length is unknown before reaching a branch area in conveyance for double-sided image formation, without having to guide it to a sheet inverting unit.

Accordingly, a first aspect of the present invention provides an image forming apparatus capable of executing a double-sided mode in which images are formed on both sides of a sheet, comprising a sheet feeding unit configured to feed a sheet, an image forming unit configured to form images on the sheet fed from the sheet feeding unit, a sheet inverting unit configured to invert the sheet, on which an image has been formed on a first side thereof by the image forming unit, in the double-sided mode, a sheet discharge tray onto which the sheet on which the mage has been formed by the image forming unit is discharged, a switching unit configured to switch a conveyance destination for the sheet to a first conveying path leading toward the sheet inverting unit or a second conveying path leading to the sheet discharge tray, a detection unit configured to detect a length of the sheet, which is fed from the sheet feeding unit, in a conveying direction while the sheet is being conveyed, and a control unit configured to, when a size of the sheet has not been undetermined, and a detection result is not obtained by the detection unit by the time the sheet reaches the switching unit in the double-sided mode, control the switching unit so that the sheet with the image formed on the first side thereof can be conveyed to the second conveying path.

According to the present invention, double-sided image formation using a sheet feeding unit from which irregular-size sheets can be fed is enabled, and a sheet, whose sheet length is unknown before reaching a branch area in conveyance for double-sided image formation, can be discharged without having to guide it to a sheet inverting unit. This improves usability during double-sided image formation and reduces downtime of the apparatus.

Further features of the present invention will become apparent from the following description of exemplary embodiments (with reference to the attached drawings).

BRIEF DESCRIPTION OF THE DRAWINGS

FIG. 5 is a view showing information in which sheet type, sheet length, and whether or not execution of a double-sided mode is possible are correlated with each other.

DESCRIPTION OF THE EMBODIMENTS

The present invention will now be described with reference to the drawings showing an embodiment thereof.

Figure 1:
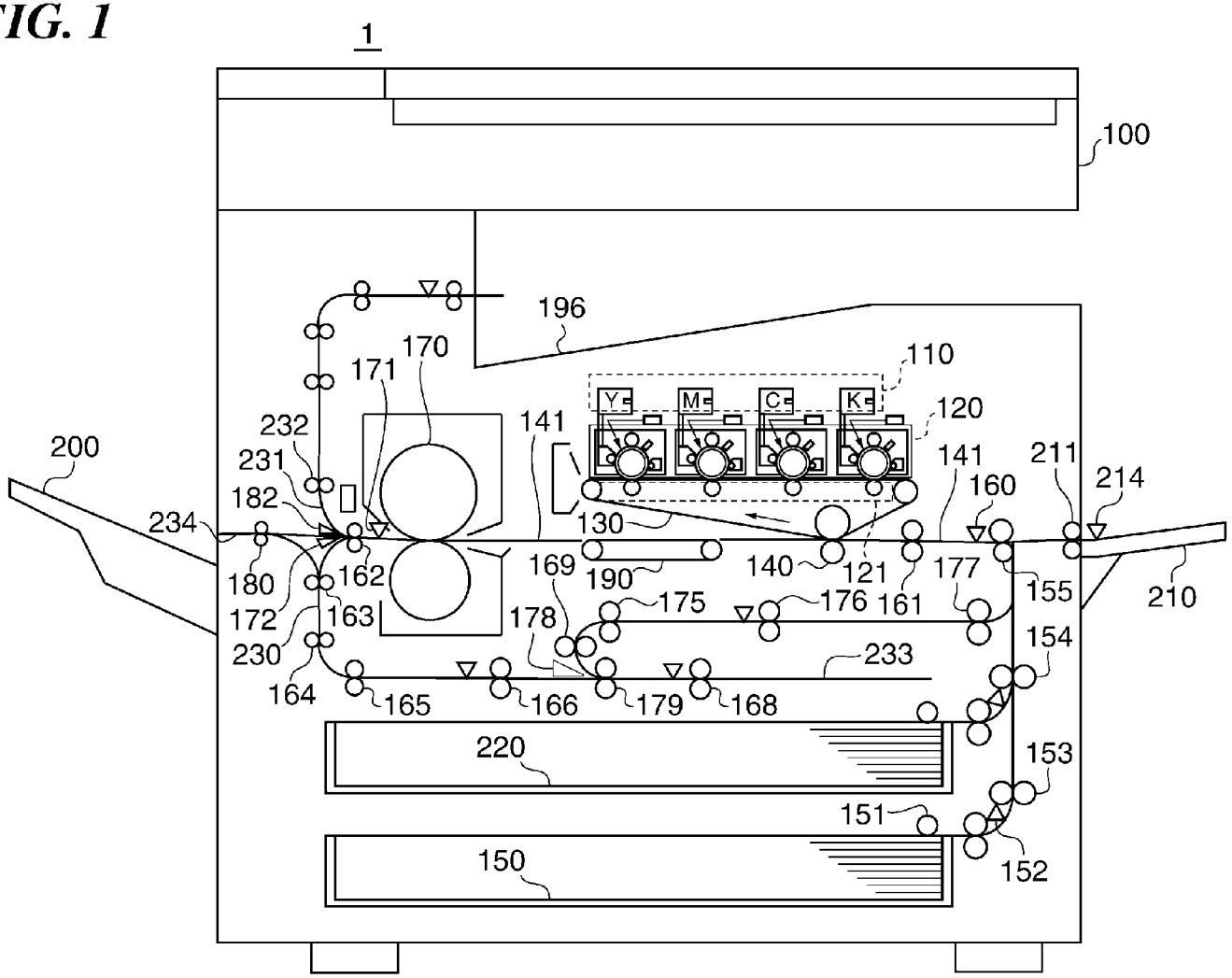
FIG. 1 is a cross-sectional view showing an image forming apparatus according to an embodiment of the present invention.
Figure 2:
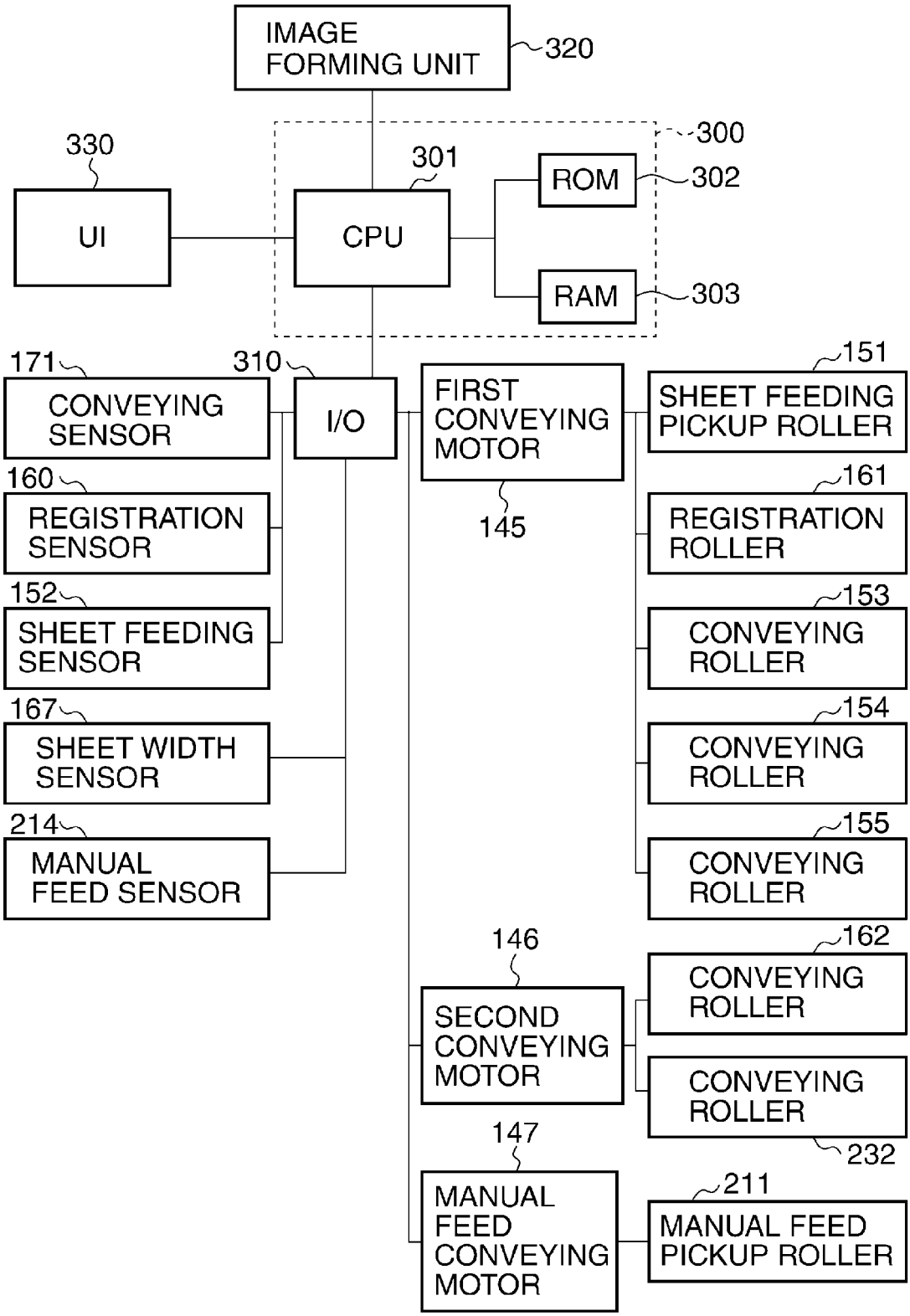
FIG. 2 is a control block diagram of the image forming apparatus in FIG. 1.

FIG. 1 is a cross-sectional view showing an image forming apparatus 1 according to an embodiment of the present invention. FIG. 2 is a control block diagram of the image forming apparatus 1. Referring to FIGS. 1 and 2, a description will now be given of a basic arrangement and operation of the image forming apparatus 1.

The image forming apparatus 1 is configured as an electrophotographic color printer. The image forming apparatus 1 has only to be capable of forming images in a double-sided mode, and for example, may be a monochrome printer, a copier, a facsimile apparatus, or a multifunctional peripheral.

Referring to FIG. 1, the image forming apparatus 1 has sheet feeding cassettes 150 and 220 and a manual feed tray 210 which are sheet feeding units for supplying sheets. The sheet feeding cassettes 150 and 220 are sheet feeding units in which sheets in regular sizes are housed. The manual feed tray 210 is a sheet feeding unit on which rectangular sheets in not only regular sizes but also irregular sizes can be placed and from which they can be fed. The image forming apparatus 1 also has a sheet discharge tray 196 and a sheet discharge tray 200 for discharging sheets, which are introduced from the sheet feeding units into the apparatus, from the apparatus.

In the image forming apparatus 1, a double-sided mode in which images are formed on both sides of a sheet and a single-sided mode in which an image is formed on one side of a sheet can be selectively carried out as image formation mode (or print modes). A normal sheet feeding mode in which sheets are fed from the sheet feeding cassette 150 or the sheet feeding cassette 220 and a manual sheet feeding mode in which sheets are fed from the manual feed tray 210 can be selectively set as sheet feeding modes. In the manual sheet feeding mode, a size specifying mode in which a user specifies a sheet size and a non-specified size mode in which no sheet size is specified can be selectively set. In the non-specified size mode, a sheet size is undetermined when feeding of sheets from the manual feed tray 210 is started.

Referring to FIG. 2, the image forming apparatus 1 has various motors, rollers, and sensors as well as a control unit 300, an image forming unit 320, a UI 330. The UI 330 is a user interface having an operation unit and a display unit. The image forming unit 320 has component elements concerned with image formation such as a process unit 120, a transfer belt 130, a secondary transfer unit 140, a laser scanner unit 110, and a fixing device 170 appearing in FIG. 1.

The control unit 300 has a CPU 301, a ROM 302, and a RAM 303. When an instruction to start printing is input to the CPU 301 via the UI 330, the CPU 301 drivingly controls a first conveying motor 145 and a second conveying motor 146 connected to the CPU 301 via an I/O 310. Detection signals from a conveyance sensor 171, a registration sensor 160, a sheet-feeding sensor 152, a sheet width sensor 167, a manual feed sensor 214 are supplied to the CPU 301 via the I/O 310.

The CRU 301, which controls the image forming unit 320, is able to provide high-voltage control and driving control over the process unit 120, the transfer belt 130, the secondary transfer unit 140, and so on and also provide control over the laser scanner unit 110 and the fixing device 170.

The CPU 301 executes control programs stored in the ROM 302, and on this occasion, the RAM 303 is used as a work area. Thus, all processes in flowcharts, to be described later, are carried out by the CPU 301. Data defined as fixed values is stored in the ROM 302, and the RAM 303 is used for temporary storage of data.

The first conveying motor 145 is a driving source for a sheet-feeding pickup roller 151, registration rollers 161, and conveying rollers 153, 154, and 155. The second conveying motor 146 is a drive source for conveying rollers 162 and 232. The CPU 301 also drivingly controls a manual feed conveying motor 147 connected to the CPU 301 via the I/O 310. The manual feed conveying motor 147 is a drive source for manual feed pickup rollers 211.

When an instruction to start printing is received via the UI 330 or the like, the CPU 301 drivingly controls the first conveying motor 145 via the I/O 310, thus rotatively driving the sheet-feeding pickup roller 151 to feed sheets from the sheet feeding cassette 150 one by one. At this time, by using the sheet-feeding sensor 152, the CPU 301 performs monitoring to check if sheets have been successfully fed. The same operation is carried out in a case where sheets are fed from the sheet feeding cassette 220.

A description will now be given of sheet conveyance from the manual feed tray 210. Upon receiving an instruction to feed sheets on the manual feed tray 210 via the UI 330, the CPU 301 drivingly controls the manual feed conveying motor 147 via the I/O 310. This rotatively drives the manual feed pickup rollers 211, causing sheets on the manual feed tray 210 to be fed and conveyed one by one. At this time, the CPU 301 monitors the registration sensor 160 to check if sheets have been successfully fed. The manual feed sensor 214 checks whether sheets are placed on the manual feed tray 210.

Sheets fed from any of the sheet feeding units are conveyed on a sheet conveying path 141 from the conveying rollers 155 to the conveying rollers 162. Also, when an image is to be formed on a reverse side of a sheet in the double-sided mode, the inverted sheet is conveyed on the sheet conveying path 141 from the conveying rollers 155 toward the conveying rollers 162.

On the other hand, the CPU 301 starts an image forming operation using the process unit 120 in time for arrival of a sheet at the secondary transfer unit 140 disposed partway along the sheet conveying path 141. The process unit 120 is comprised of a photosensitive drum, a developing device, a charging roller, a photosensitive drum cleaner, and so on.

In the process unit 120, a surface of the photosensitive drum is charged with electricity, and then a latent image is formed on the photosensitive drum by laser light radiated from the laser scanner unit 110. The latent image formed on the photosensitive drum is then developed on the photosensitive drum by toner in the developing device. Thereafter, in the primary transfer unit 121, primary transfer voltage is applied to the toner image developed on the photosensitive drum, and the latent image is transferred to the transfer belt 130. The toner image transferred to the transfer belt 130 is conveyed to the secondary transfer unit 140 through rotation of the transfer belt 130.

The CPU 301 detects a position of a sheet conveyed by the conveying rollers 153, the conveying rollers 154, and the conveying rollers 155 by monitoring outputs from the registration sensor 160. With consideration given to the timing with which a leading end of the sheet reaches the registration sensor 160, conveyance of the sheet is controlled so that the leading end of the sheet and a leading end of a one-page area on the transfer belt 130 can coincide with each other in the secondary transfer unit 140. For example, when the sheet moves ahead of the toner image, the sheet is stopped for a predetermined time period by the registration rollers 161, and then conveyance of the sheet is resumed.

Secondary transfer voltage is applied to the sheet and the toner image which have reached the secondary transfer unit 140 in the above described manner, so that the toner image is transferred to the sheet. The sheet subjected to the secondary transfer is conveyed to the conveying belt 190 and the fixing device 170. In the fixing device 170, the toner image on the sheet is fixed by heating. Thereafter, the sheet is conveyed further to a downstream side in the apparatus.

The conveyance sensor 171 is disposed downstream of the fixing device 170. When the leading end of the sheet on which the toner image has been fixed reaches the conveyance sensor 171, the CPU 301 selects one of a sheet conveying path 230, which is a first conveying path, and sheet conveying paths 231 and 234, which are second conveying paths, as a conveying path to which the sheet should be conveyed. This selection is made in accordance with an instruction issued in advance via the UI 330. In accordance with the selection, a conveying flapper 172 and a conveying flapper 182 placed downstream of the conveying rollers 162 are actuated to switch destinations to which the sheet is conveyed. Namely, the conveying flapper 172 and the conveying flapper 182 act as switching units that switch destinations to which a sheet is conveyed.

Figure 3:
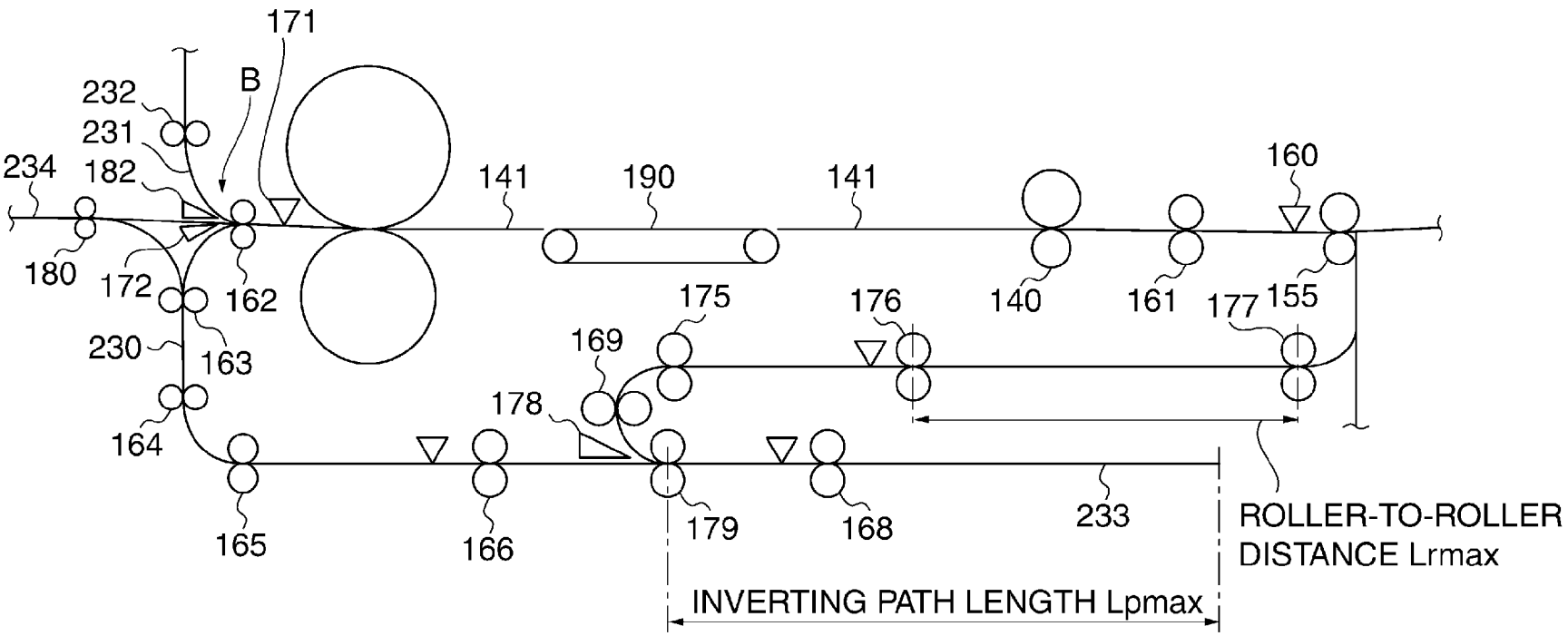
FIG. 3 is an enlarged view showing an essential part of a sheet conveying path in the image forming apparatus.

FIG. 3 is an enlarged view showing an essential part of sheet conveying paths in the image forming apparatus 1. In an area downstream of the sheet convening path 141, conveyance destinations branch at a location where the conveyance sensor 171, the conveying rollers 162, and the conveying flappers 172 and 182 are placed (hereafter referred to as "the branch area B"). As shown in FIGS. 1 and 3, among branch destinations, a conveying path leading from the branch area B toward a double-sided inversion conveying path 233, which is a sheet inverting unit, is the sheet conveying path 230. A conveying path leading from the branch area B toward the sheet discharge tray 196 is the sheet conveying path 231. A conveying path leading from the branch area B toward the sheet discharge tray 200 is the sheet conveying path 234.

The conveying flappers 172 and 182 are actuated by the CPU 301 and take three positions by combining their positions. A destination to which a sheet is conveyed from the branch area B is defined by what positions they take.

Specifically, in the double-sided mode or in a case where a sheet is discharged with its print side facing down on the sheet discharge tray 200, the CPU 301 provides control to switch the conveying flapper 172 so that the sheet can be conveyed to the sheet conveying path 230. In the single-sided mode or in a case where a sheet is discharged to the sheet discharge tray 196, the CPU 301 provides control to switch the conveying flapper 182 so that the sheet can be conveyed to a sheet conveying path 231. The sheet conveyed to the sheet conveying path 231 is conveyed further downstream by the conveying rollers 232 and others and discharged to the sheet discharge tray 196.

Further, when there is an instruction to discharge a sheet to the sheet discharge tray 200, the CPU 301 provides control to switch the conveying flapper 172 and the conveying flapper 182 so that the sheet can be conveyed to the sheet conveying path 234.

In the double-sided mode, a sheet with its first side printed goes to the sheet conveying path 230 and is conveyed directly to a double-sided inversion conveying path 233 by double-sided conveying rollers 164, 165, 166, 179, and 168. Thereafter, when a trailing end of the sheet passes the double-sided conveying rollers 179, the CPU 301 switches a double-sided inverting flapper 178 so as to guide the sheet toward double-sided conveying rollers 169 and reverse the rotation of the double-sided conveying rollers 179 and 168. The sheet is then conveyed by the double-sided conveying rollers 169, 175, 176, and 177 and passed to conveying rollers 155. The sheet is then introduced into the sheet conveying path 141 again, and an image is formed on a reverse side of the sheet.

When a sheet is to be discharged with its print side facing down on the sheet discharge tray 200 in the single-sided mode, the sheet temporarily goes to the sheet conveying path 230. When a trailing end of the sheet then passes inverting rollers 163, the CPU 301 provides control to reverse the rotation of the double-sided conveying rollers 164, 165, 166, 179, and 168 so that the sheet can be conveyed toward sheet discharging rollers 180, and discharges the sheet to the sheet discharge tray 200 through the sheet conveying path 234.

It should be noted that the basic image forming operation described above is merely an example, and the present invention is not limited to this.

Figure 4:
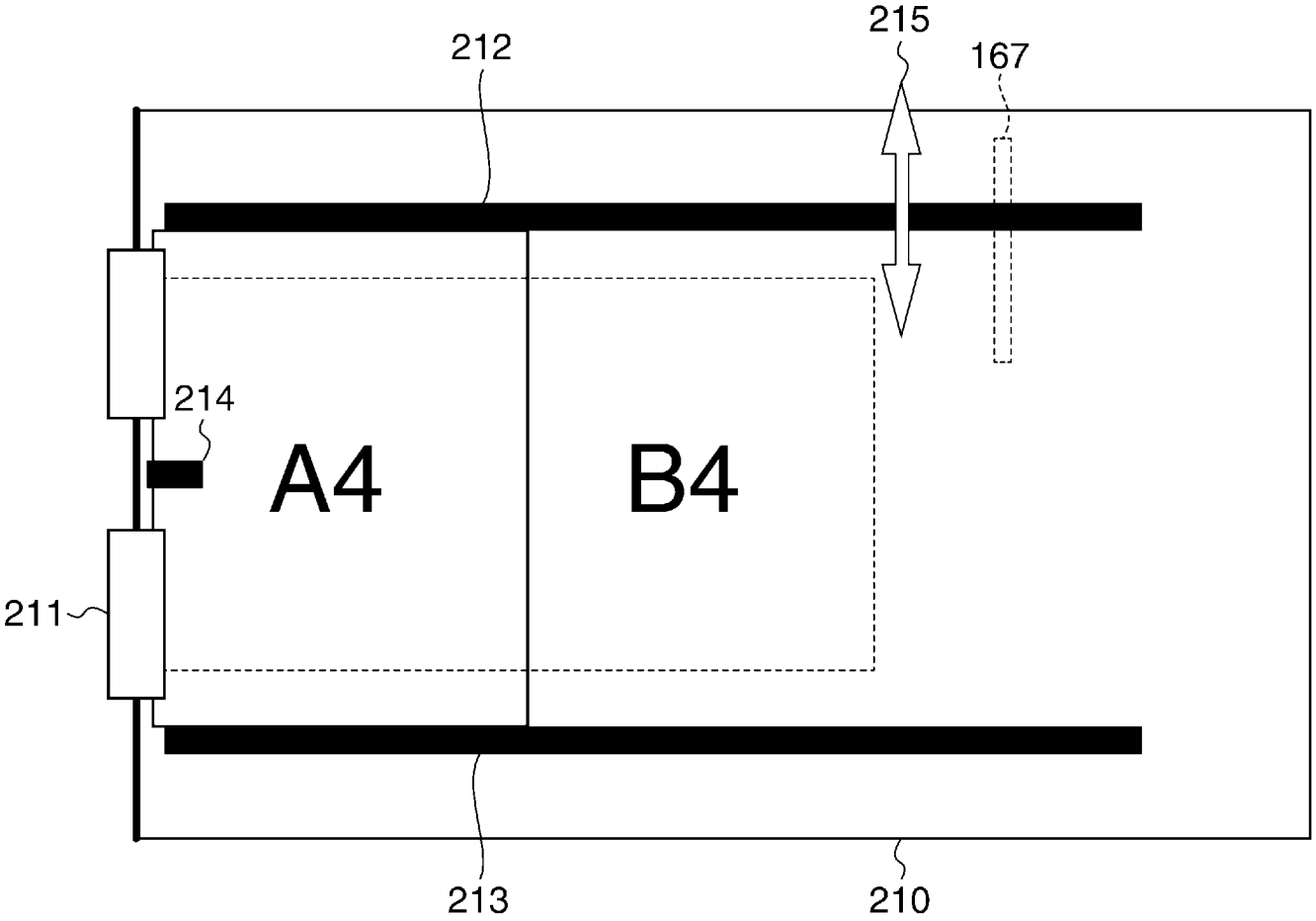
FIG. 4 is a top view showing a manual feed tray.

FIG. 4 is a top view showing the manual feed tray 210. Sheets placed on the manual feed tray 210 are separated and conveyed by manual feed pickup rollers 211. The placed sheets are sandwiched by side restriction guides 212 and 213 so as to be prevented from being skewed while being conveyed by the manual feed pickup rollers 211.

In the description of the present embodiment, a length of a sheet in a conveying direction is referred to as a sheet length or merely as a length, and a length of a sheet in a direction perpendicular to the conveying direction is referred to as a sheet width.

Even when sheets with a sheet width different from that of sheets placed previously are placed on the manual feed tray 210, skew of the sheets during feeding can be prevented by a user sliding the side restriction guides 212 and 213 in a direction indicated by an arrow 215. The side restriction guides 212 and 213 are connected to the sheet width sensor 167 via a link, not shown, and a value corresponding to a position of the side restriction guide 212 in a width direction is input to the CPU 301. The CPU 301 detects a sheet width based on the input value.

Referring next to FIG. 3, a description will be given of the relationship between sheet lengths with which the double-sided mode can be executed and conveying rollers/conveying paths.

In order to execute the double-sided mode, first, it is necessary to reliably deliver a sheet between conveying rollers. Accordingly, a sheet length should be longer than the longest distance among distances between conveying rollers on a conveying path from the sheet conveying path 230 back to the sheet conveying path 141 via the double-sided inversion conveying path 233. In the present embodiment, the distance between the double-sided conveying rollers 176 and the double-sided conveying rollers 177 is the longest, and this is referred to as the roller-to-roller distance Lrmax. Thus, a lower limit to a conveyable sheet length is the roller-to-roller distance Lrmax+$\alpha$. In the present embodiment, $\alpha$ is 5 mm, but may be other values.

In order to execute the double-sided mode, it is also necessary to invert a sheet on the double-sided inversion conveying path 233. If a sheet length of a sheet is greater than the length of the double-sided inversion conveying path 233, the sheet cannot be inverted. Accordingly, a sheet length should be equal to or smaller than the maximum length of a sheet that can be inverted on the double-sided inversion conveying path 233. In the present embodiment, a length from the double-sided conveying rollers 179 to a leading end (an end on the rear side) of the double-sided inversion conveying path 233 is referred to as the inversion path distance Lpmax. An upper limit to an invertible sheet length is the inversion path distance Lpmax.

When a sheet length is referred to as L, the sheet length L needs to be within a predetermined range (a range from Lrmax+α to Lpmax) in order to execute the double-sided mode, and namely, a first condition, Lrmax+α≤L≤Lpmax should be satisfied.

Here, FIG. 5 shows a table in which whether or not it is possible to execute the double-sided mode are correlated with sheet types in a case where the roller-to-roller distance Lrmax is 150 mm, and the inversion path length Lpmax is 460 mm.

Information in FIG. 5 in which sheet type (size and feed direction), sheet length, and whether or not it is possible to execute a double-sided mode are correlated with each other is stored in advance in the ROM 302. The minimum size of regular-size sheets for which the double-sided mode can be executed is B5 long edge feed (132 mm), and the maximum size of them is 12×18 short edge feed (457.2 mm). It should be noted that long edge feed is such conveyance that a short edge of a sheet is parallel to the conveying direction, and long edge feed is such conveyance that a long edge of a sheet is parallel to the conveying direction.

In the manual sheet feeding mode, according to whether or not it is possible to properly execute the double-sided mode, the CPU 301 switches the conveying flappers 172 and 182, causing a destination to branch from a branch area B. Accordingly, before a time at which a sheet conveyed on the sheet conveying path 141 reaches the branch area B, the CPU 301 needs to determine whether or not it is possible to execute the double-sided mode. Here, the phrase that "a time at which a sheet reaches the branch area B" is synonymous with "the time to switch the conveying flappers 172 and 182", and in terms of control, means "the time at which the conveying sensor 171 is turned on". It should be noted that the conveying sensor 171 is preferably disposed closer to the conveying flapper 172 and 182, but in the present embodiment, the conveying sensor 171 is disposed 30 mm upstream of these flappers.

In the manual size specifying mode, a sheet size is determined before a sheet reaches the branch area B, and hence a destination is branched according to the sheet length L found from the sheet size.

On the other hand, in the non-specified size mode, a sheet length L is undetermined at the start of sheet feeding. Thus, by carrying out a sheet length detection process in FIG. 12, to be described later, the CPU 301 detects a sheet length L while conveying a sheet on the sheet conveying path 141. When the CPU 301 grasps the sheet length L by the time the sheet reaches the branch area B, the CPU 301 branches a destination according to the sheet length L. However, when the CPU 301 cannot grasp the sheet length L by the time the sheet reaches the branch area B, the CPU 301 provides control to convey the sheet to the same branch destination as in a case where it is impossible to execute the double-sided mode because whether or not it is possible to execute the double-sided mode is unknown.

Therefore, a second condition that should be satisfied in order to execute the double-sided mode is that the CPU 301 can grasp a sheet length L by the time a sheet reaches the branch area B. When the first and second conditions described above are satisfied, a sheet is conveyed from the branch area B to the sheet conveying path 230.

Referring next to FIGS. 6 to 10, a description will be given of how various modes and others are set using the UI 330. FIGS. 6 to 10 are views showing exemplary display screens displayed in a display section of the UI 330.

Figure 6:
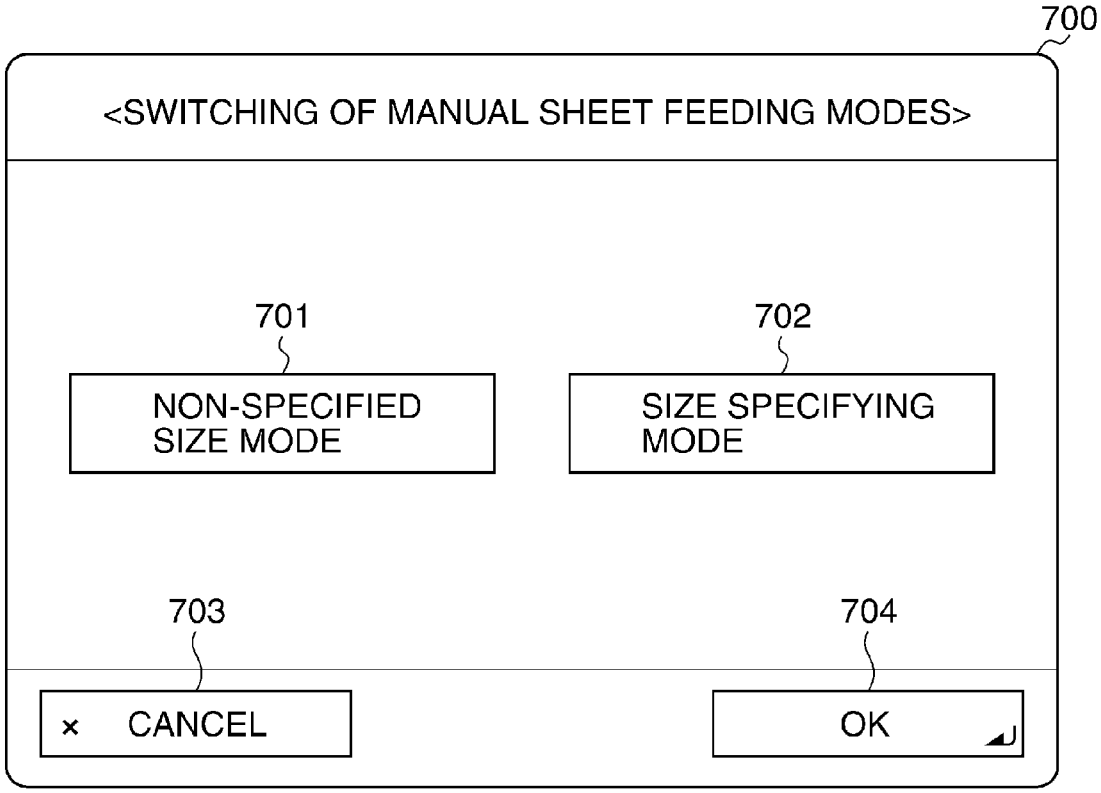
FIG. 6 is a view showing a manual sheet feeding mode switching screen.

On the manual sheet feeding mode switching screen 700 in FIG. 6, a user selectively turns on the non-specified size mode button 701 or a size specifying mode button 702 and then turns on an OK button 704. Then, the non-specified size mode or the size specifying mode is set. The CPU 301 stores the setting information in the RAM 303. It should be noted that when a cancel button 703 is turned on, the state returns to a state before mode selection.

Figure 7:
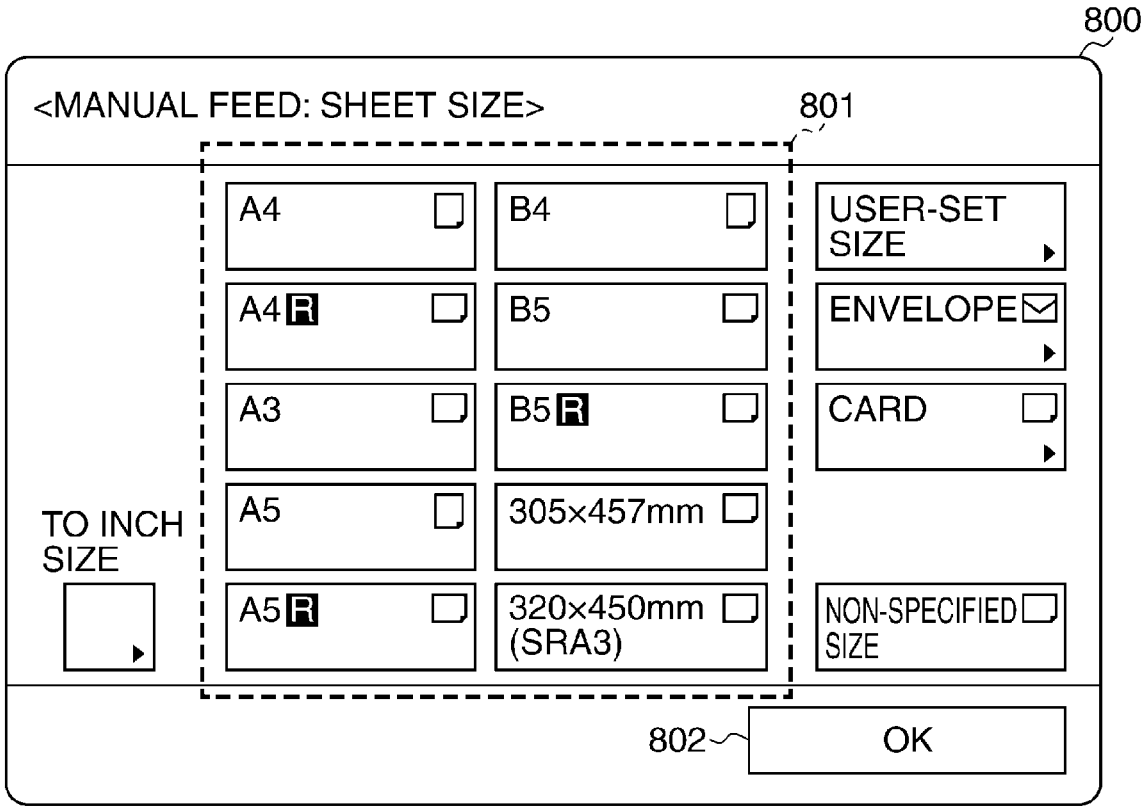
FIG. 7 is a view showing a manual feed size setting screen.

When the manual feed sensor 214 detects a sheet placed on the manual feed tray 210 in a state where the manual size specifying mode has been set, a manual feed size setting screen 300 that prompts the user to set a sheet size is displayed as shown in FIG. 7. By the user successively turning on a button 801, which is for inputting a sheet size, and an OK button 802, the input sheet size is received and the sheet size is determined, and the CPU 301 stores information on the determined sheet size in the RAM 303.

Figure 8A:
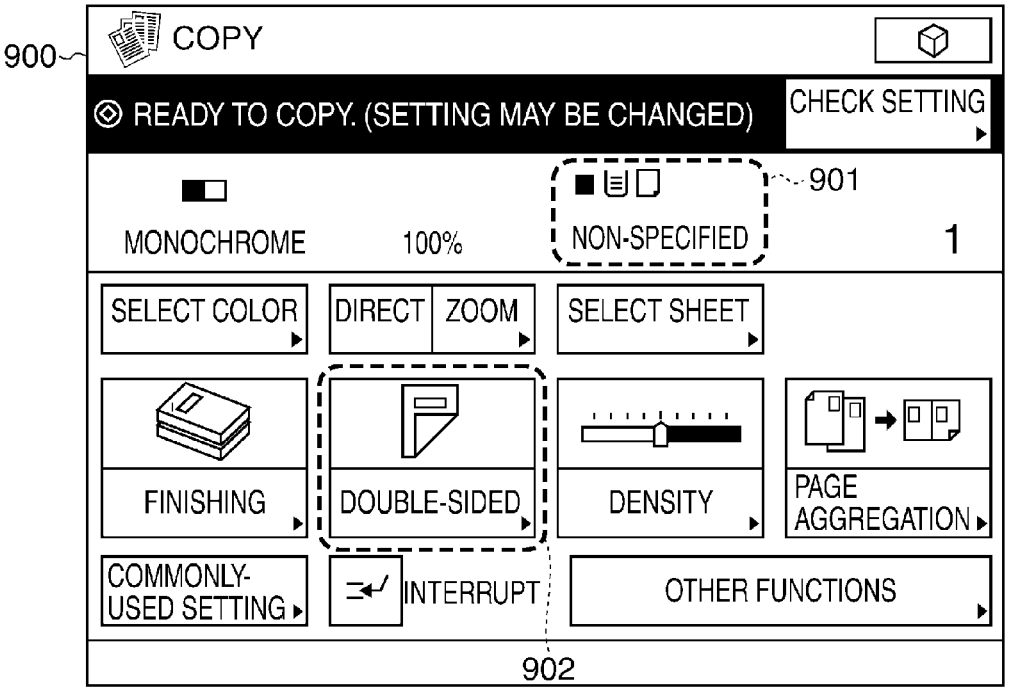
FIGS. 8A and 8B are views showing a setting information display screen.
Figure 8B:
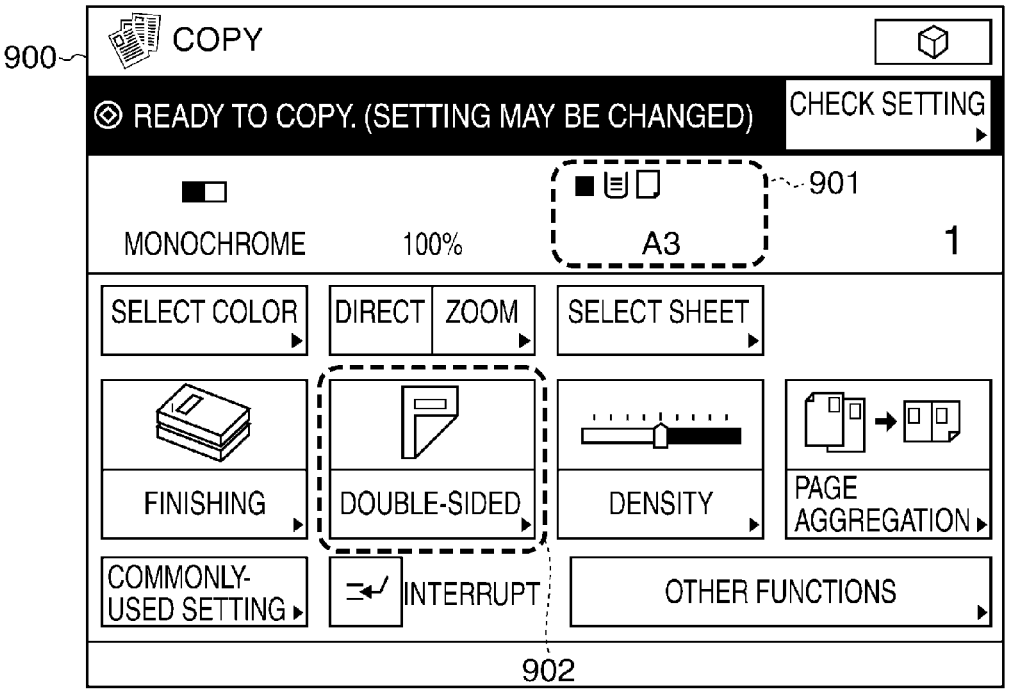

What was set on the setting screens in FIGS. 6 and 7 is displayed on a setting information display screen 900 appearing in FIG. 8A or FIG. 8B. In a size display section 901, the word "free" is displayed when the non-specified size mode is set (FIG. 8A), and the specified sheet size is displayed when the size specifying mode is set (FIG. 8B).

Figure 9:
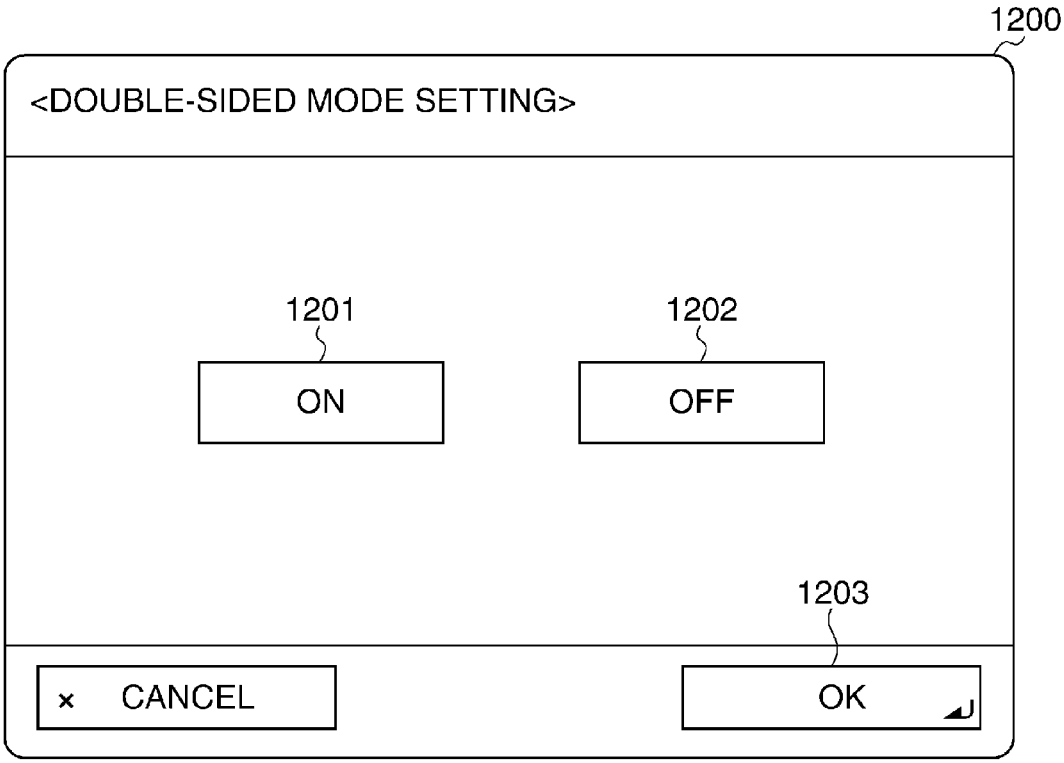
FIG. 9 is a view showing a double-sided mode setting screen.

When a double-sided mode setting button 902 is turned on on the setting information display screen 900, a double-sided mode setting screen 1200 is displayed as shown in FIG. 9. Here, when the user selects an OFF button 1202 and turns on an OK button 1203, the image formation mode setting returns to the single-sided mode. On the other hand, when the user selects an OK button 1201 and turns on the OK button 1203, a notification screen 1300 is displayed as shown in FIG. 10.

This notification screen 1300 is for prompting the user to set a sheet size in a case where both the double-sided mode and the non-specified size mode are set. Namely, it is notified that the sheet may be discharged only after single-sided image formation without performing double-sided image formation. When the user turns on an OK button 1302, processes FIG. 13 and FIG. 14, referred to later, are started with both the double-sided mode and the non-specified size mode set.

On the other hand, when the user turns on a size specifying button 1301 on the notification screen 1300, the manual feed size setting screen 300 (FIG. 7) is displayed on the UI 330, and this enables the user to specify a size of the sheet placed on the manual feed tray 210. When the size is specified here, the manual sheet feeding mode setting shifts to the size specifying mode, and the setting information display screen 900 in FIG. 8B is displayed.

Figure 10:
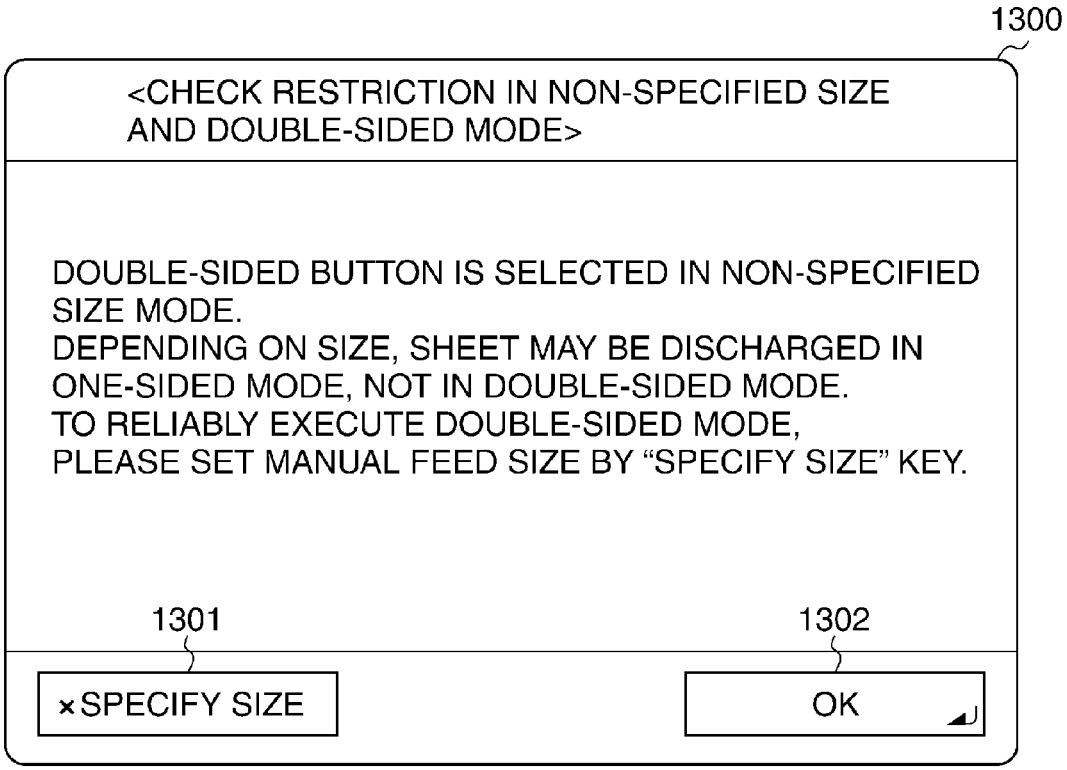
FIG. 10 is a view showing a notification screen.

It should be noted that when a start button, not shown, is turned on with the setting information display screen 900 in FIG. 8A being displayed, the notification screen 1300 in FIG. 10 is displayed. When a start button, not shown, is turned on with the setting information display screen 900 in FIG. 8B being displayed, the process in FIG. 13 and FIG. 14, referred to later, is started with both the double-sided mode and the size specifying mode set.

Figure 11:
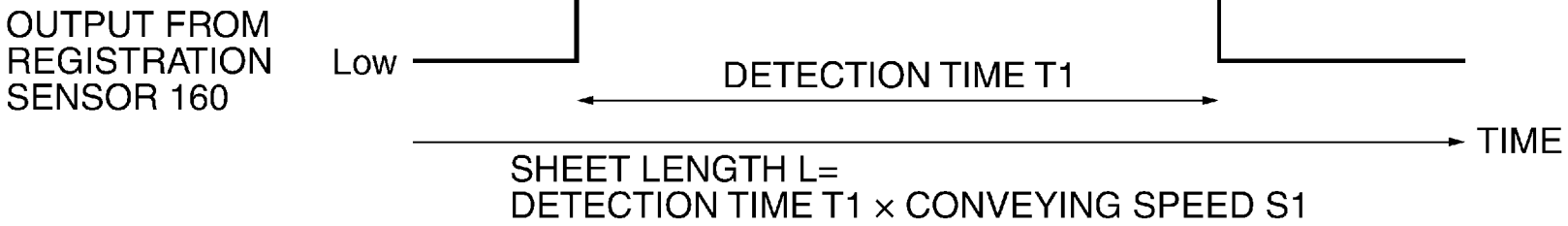
FIG. 11 is a time chart showing changes in output from a registration sensor.
Figure 12:
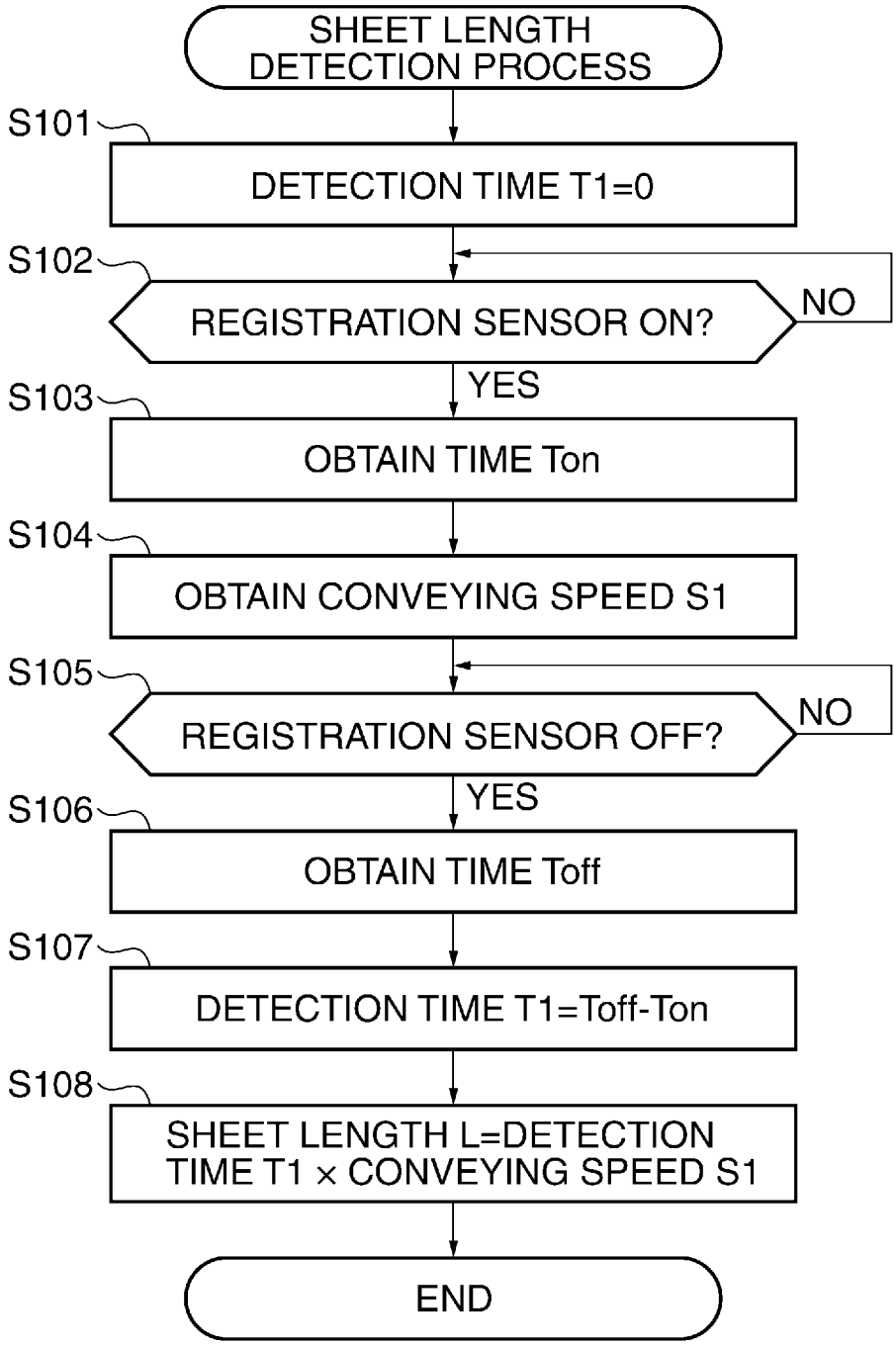
FIG. 12 is a flowchart of a sheet length detection process.

Referring next to FIGS. 11 and 12, a description will be given of how a sheet length L is detected. FIG. 11 is a timing chart showing changes in output from the registration sensor 160. FIG. 12 is a flowchart of a sheet length detection process.

The sheet length L is determined based on a time period it takes for a trailing end of a sheet to pass a predetermined position on the sheet conveying path 141 after a leading end thereof passes the predetermined position, and a convening speed of the sheet during this time period. In the present embodiment, the sheet length L is determined based on a time period during which the registration sensor 160 is held on by detecting a sheet and a conveying speed of the sheet during this time period. It should be noted that the predetermined position is preferably close to the manual feed tray 210, and should not necessarily be at a position of the registration sensor 160 but may be at any position on the sheet conveying path 141. A sensor for use in detecting a sheet length should not necessarily be the registration sensor 160.

First, as shown in FIG. 11, a time period it takes for the registration sensor 160 to be turned off at a time point T401 after being turned on at a time point T400 is a time period it takes for a trailing end of a sheet to pass a position at which the registration sensor 160 is disposed after a leading end thereof passes this position. This time period is regarded as a detection time period T1. A conveying speed of the sheet during the detection time period T1 is designated as S1. The sheet length L is calculated using the following equation, L−T1×S1.

Referring to FIG. 12, a description will now be given of a sequence in which the CPU 301 actually calculates the sheet length L.

First, the CPU 301 initializes a value of the detection time period T1 (step S101) and waits until the registration sensor 160 is turned on (step S102), When the registration sensor 160 is turned on, the CPU 301 obtains a time Ton at this time point (step S102) and also obtains a conveying speed S1 at this time point (step S104).

Next, the CPU 301 waits until the registration sensor 160 is turned off (step S105). When the registration sensor 160 is turned off, the CPU 301 obtains a time Toff at this time point (step S106). Namely, the sheet length has not been determined by the time a rear end of the sheet passes the registration sensor 160.

The CPU 301 then calculates a detection time period T1 (T1=Toff−Ton) by subtracting the obtained time Ton from the obtained time Toff (step S107). Then, by multiplying the detection time period T1 by the conveying speed S1 (L=T1×S1), the CPU 301 determines the result as a sheet length L (step S108) and terminates the process in FIG. 12. The obtained sheet length L is stored in the RAM 303.

It should be noted that when the conveying speed S1 changes during a time period for which the registration sensor 160 is on, the conveying speed S1 may be obtained as an average speed during the time period for which the registration sensor 160 is on from values measured as the need arises. Alternatively, the time period may be divided into sections by speed changing time points, and lengths calculated in the respective sections may be summed to obtain the sheet length L.

Figure 13:
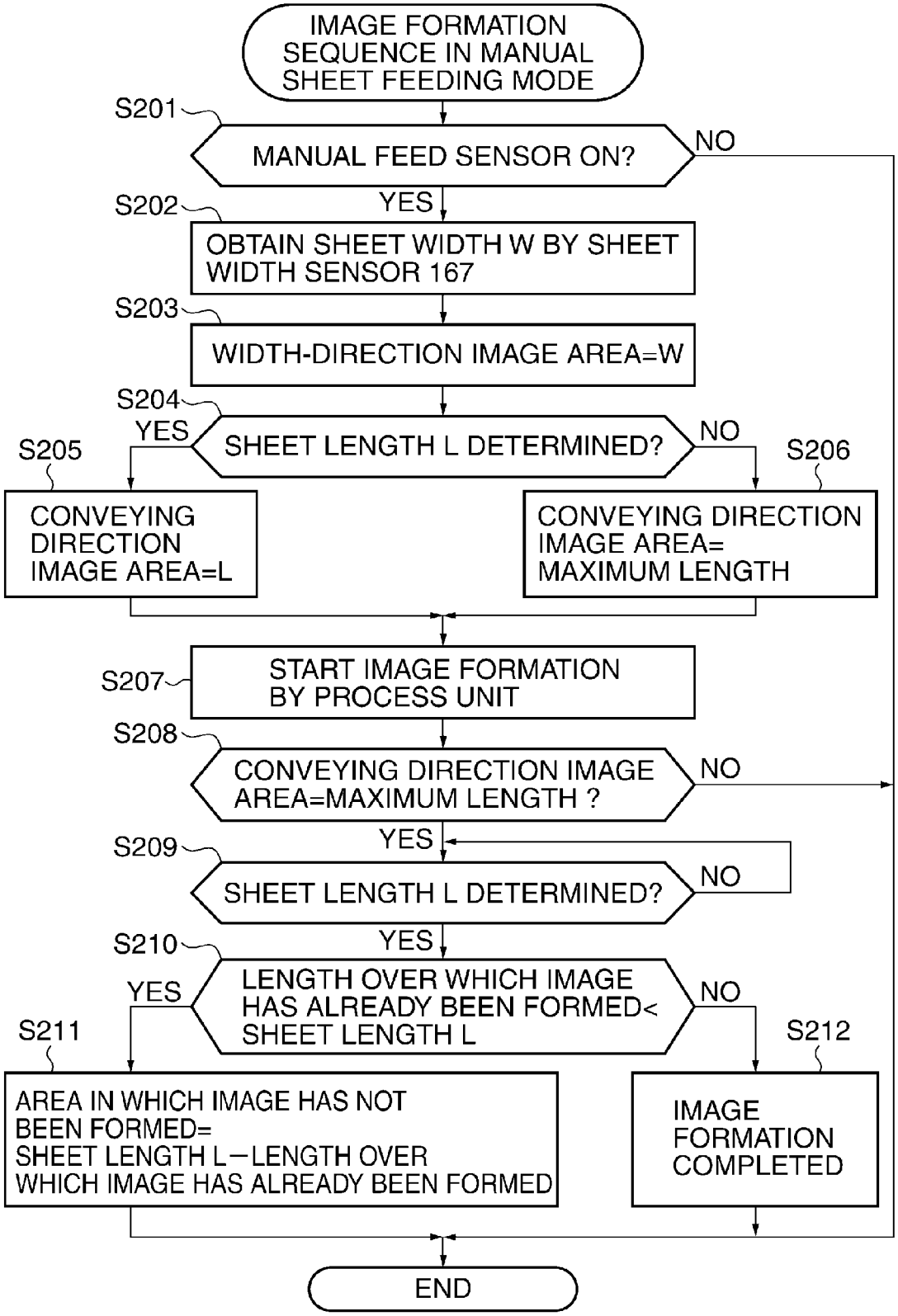
FIG. 13 is a flowchart of an image formation sequence process in a manual sheet feeding mode.

A description will now be given of an image formation sequence in a case where the manual sheet feeding mode is set. FIG. 13 is a flowchart of the image formation sequential process in the manual sheet feeding mode. This process is started when a start button, not shown, or a button which corresponds thereto and is for giving an instruction to start the process is turned on with the manual sheet feeding mode being set.

First, the CPU 301 determines whether or not the manual feed sensor 214 is on (step S201). When the manual feed sensor 214 is not on, it is regarded that no sheet is placed on the manual feed tray 210 and thus the CPU 301 terminates the process in FIG. 13. On the other hand, when the manual feed sensor 214 is on, the CPU 301 obtains a sheet width W of a sheet, which is placed on the manual feed tray 210, based on a detection signal from the sheet width sensor 167 (step S202). The CPU 301 then sets the obtained sheet width W as an across-the-width image area which is a range where an image is formed in a width direction by the process unit 120 (step S203).

Next, the CPU 301 determines whether or not it has already grasped the sheet length L, that is, whether or not it has already determined the sheet length L (step S204). Here, when the size specifying mode is set, the sheet length L has already been determined. On the other hand, when the non-specified size mode is set, the sheet length L has already been determined if calculation of the sheet length L had been completed by the sheet length detection process in FIG. 12, but if not, the sheet length L has not yet been determined.

As a result, of the determination in the step S204, when the sheet length L has already been determined, the CPU 301 sets the sheet length L as an image area in the conveying direction, which is a range where an image is formed in the conveying direction (step S205). On the other hand, when the sheet length L has not yet been determined, the CPU 301 sets an image area in the conveying direction at the maximum length (step S206).

The CPU 301 then causes the process unit 120 to start an image forming operation (step S207) and determines whether or not the image area in the conveying direction is set at the maximum length (step S208). As a result of the determination in the step S208, when the image area in the conveying direction is not set at the maximum length, the CPU 301 terminates the process in FIG. 13 because it has already grasped the sheet length L. On the other hand, when the image area in the conveying direction is set at the maximum length, the CPU 301 has not yet grasped the sheet length L and thus waits until the sheet length L is determined by the sheet length detection process in FIG. 12 (step S209).

When the sheet length L is determined, the CPU 301 determines whether or not a length of an image in the conveying direction along which the image has already been formed by the process unit 120 is smaller than the sheet length L (step S210). As a result of the determination in the step S210, when the length of the formed image is smaller than the sheet length L, the CPU 301 subtracts the length of the formed image from the sheet length L to determine an image-unformed area in which an image has not yet been formed (step S211). On the other hand, when the length of the formed image has reached the sheet length L, the CPU 301 brings image formation to an end because image formation along a required length in the conveying direction has been completed (step S212). After completion of the steps S211 and S212, the process in FIG. 13 is brought to an end.

It should be noted that an image formation sequence in a normal sheet feeding mode in which the manual feed tray 210 is not used is not illustrated, but this is basically the same as the process in FIG. 13. However, an image area in the conveying direction and an image area in the width direction are set according to a sheet size determined by a cassette for use in sheet feeding.

Figure 14:
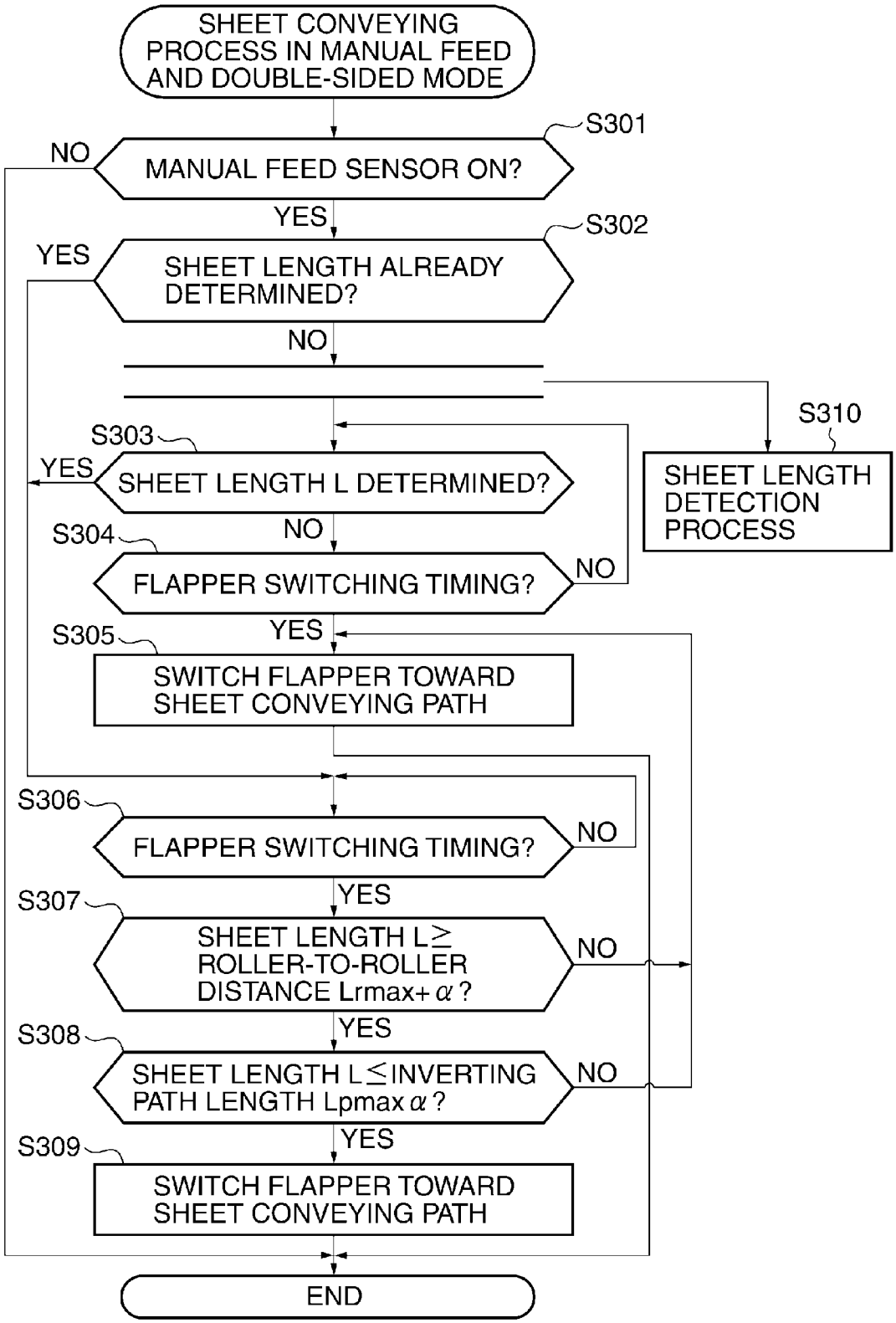
FIG. 14 is a flowchart of a sheet conveyance process in a manual feed/double-sided mode.

FIG. 14 is a flowchart of a sheet conveying process in the manual feed/double-sided mode executed in a state in which the manual sheet feeding mode and the double-sided mode are set. This process is started when the OK button 1302 (FIG. 10) is turned on, or when a start button, not shown, is turned on with the setting information display screen 900 in FIG. 8B being displayed.

First, the CPU 301 determines whether or not the manual feed sensor 214 is on (step S301). When the manual feed sensor 214 is not on, it is regarded that no sheet is placed on the manual feed tray 210 and thus the CPU 301 terminates the process in FIG. 14. On the other hand, when the manual feed sensor 214 is on, the CPU 301 determines whether or not it has already grasped the sheet length L, that is, whether or not the sheet length L has already been determined (step S302).

Here, in a case where the size specifying mode is set, the sheet length L has already been determined. On the other hand, in a case where the non-specified size mode is set, the sheet length L has not yet been determined.

As a result of the determination in the step S302, when the CPU 301 determines that the sheet length L has already been determined, the process proceeds to step S306, and on the other hand, when the CPU 301 determines that the sheet length L has not yet been determined, the process proceeds to step S303 and step S310. Namely, the CPU 301 carries out processes in the step S303 and the subsequent steps and a process in the step S310 in tandem with each other. In the step S310, the CPU 301 starts the sheet length detection process described above with reference to FIG. 12.

In the step S303, the CPU 301 determines whether or not determination of the sheet length L by the sheet length detection process in FIG. 12 has been completed. Namely, the CPU 301 determines whether or not the registration sensor 160 has detected the rear end of the sheet. As a result of the determination in the step S303, when the sheet length L has not yet been determined (the registration sensor 160 has not yet detected the rear end of the sheet), the CPU 301 determines whether or not the time to switch the conveying flappers 172 and 132 has come (step S304). This switching time, which means whether or not a sheet has reached the branch area B as described above, is determined based on whether or not the conveying sensor 171 has been turned on.

When the CPU 301 determines that the time to switch the conveying flappers 172 and 182 has not yet come, the process returns to the step S303. However, when the time to switch the conveying flappers 172 and 182 has come with the sheet length L undetermined, the sheet length L is unknown, and hence the second condition described above is not satisfied. It is thus impossible to determine whether or not it is possible to execute the double-sided mode.

Therefore, the CPU 301 switches the conveying flappers 172 and 182 so as to guide a sheet toward the sheet conveying path 231 (step S305). Thus, in this case, the sheet is discharged to the sheet discharge tray 196 with an image formed on only one side of the sheet. Namely, the CPU 301 determines that such a long sheet that the double-sided mode cannot be executed is likely to be placed, suspends the double-sided mode, and provides control to shift into an operation in which the sheet is discharged with an image formed on only one side thereof. The CPU 301 then terminates the process in FIG. 14.

On the other hand, as a result of the determination in the step S303, when the sheet length L has been determined (the registration sensor 160 has detected the rear end of the sheet), the CPU 301 determines whether or not the time to switch the conveying flappers 172 and 182 has come as with the step S304 (step S306). The CPU 301 then waits until the time to switch the conveying flappers 172 and 182 comes, and when the time to switch the conveying flappers 172 and 182 comes, the process proceeds to step S307.

In the step S307, the CPU 301 determines whether or not the sheet length L is equal to or greater than the roller-to-roller distance Lrmax+α. Subsequently, in step S308, the CPU 301 determines whether or not the sheet length L is equal to or smaller than the inversion path length Lpmax. Namely, in the steps S307 and S308, the CPU 301 determines whether or not a first condition (Lrmaxα≤L≤Lpmax) is satisfied.

As a result of the determination in the step S307, when Lrmax+α>L (NO in the step S307), the CPU 301 executes the step S305 described above because the sheet length L is so small that the sheet cannot be delivered between conveying rollers. When L>Lpmax in the step S308 (NO in the step S308), the CPU 301 executes the step S305 described above because the sheet length L is so large that the sheet cannot be inverted on the double-sided inversion conveying path 233. In this case as well, the sheet with an image formed on only one side thereof is discharged to the sheet discharge tray 196.

When the condition Lrmax+α≤L≤Lpmax is satisfied (YES in the step S307 and YES in the step S308), the process proceeds from the step S307 to the step S308 and step S309 in this order because the CPU 301 determines that it is possible to properly execute the double-sided mode. In the step S309, the CPU 301 switches the conveying flappers 172 and 182 so as to guide the sheet toward the sheet conveying path 230, that is, in an original double-sided conveyance direction.

As a result, the sheet is conveyed again on the sheet conveying path 141 by way of the sheet conveying path 230 and the double-sided inversion conveying path 233, and an image is formed on a reverse side of the sheet. As with the image formation on the front side, the image formation in this case is carried out in a sequence equivalent to that in the process in FIG. 13. However, because the sheet length L has already been grasped, an image area in the conveying direction is set according to the sheet length L. After completion of the process in the step S309, the CPU 301 brings the process in FIG. 14 to an end.

By the above described process, it becomes possible to set the double-sided in the non-specified size mode as well, and whether or not to execute the double-sided mode is determined based on an actually detected sheet length L. Because a sheet can be discharged by suspending the double-sided mode while usability in the non-specified size mode is maintained, occurrence of an undesired sheet jam or the like can be avoided.

It should be noted that although in the step S305, the flappers are switched so that a sheet can be discharged to the sheet discharge tray 196, the flappers may be switched so as to guide a sheet toward the sheet conveying path 234 so that the sheet can be discharged to the sheet discharge tray 200 which is a discharge port for the single-sided mode.

It should be noted that even in a case where the sheet length L of a sheet placed on the manual feed tray 210 is unknown, the sheet length L can be grasped as long as the sheet width W of the sheet is obtained if placement of a regular-size sheet is known in some way. Accordingly, in lieu of the sheet length detection process in FIG. 12, the CPU 301 may determine the sheet length L based on a found regular size and the obtained sheet width W by referring to the information in FIG. 5. To further simplify the process, once the regular size has been found, a branch destination from the branch area B may be determined based on information about whether or not the double-sided mode is possible.

According to the present embodiment, in the double-sided mode, when a sheet size is undetermined at the start of sheet feeding, and a result of detection of the sheet length L has not been obtained (the sheet size has not been determined) by the time the sheet reaches the branch area B, the CPU 301 does not guide the sheet to the sheet conveying path 230 (first conveying path). In this case, the sheet is conveyed from the branch area B to the sheet conveying path 231 (second conveying path). When the sheet length L lies inside a predetermined range, the sheet is conveyed to the sheet conveying path 230, and when not, the sheet is conveyed to the sheet conveying path 231.

This enables double-aided image formation using the sheet feeding unit (the manual feed tray 210) capable of feeding irregular-size sheets and also enables immediate discharging of sheets whose sheet length L is unknown by the time the branch area B during conveyance for double-sided image formation. Whether a placed sheet is a regular-size sheet or an irregular-size sheet, the double-sided mode is not prohibited across the board, and hence usability can be enhanced. Moreover, even when it is determined that the double-sided mode cannot be executed, this is not dealt with as a sheet jam, and a sheet is discharged, which reduces downtime.

The sheet length detection process in FIG. 12 is carried out only when a sheet size is undetermined (when the determination result in the step S302 in FIG. 14 is negative (NO)), an unnecessary process can be avoided.

Moreover, when image formation in the doubles-sided mode is started, the notification screen 1300 in FIG. 10 is displayed to provide notification that image formation on both sides may not be performed, and hence the user can be alerted. Thus, a sheet for which double-sided printing is desired to be performed can be prevented from being subjected to only single-sided printing and discharged despite user's intent.

Further, the user is notified of shifting to the size specifying mode because the notification screen 1300 in FIG. 10 informs the user that a sheet size can be specified, and this is very convenient.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-146414, filed Jul. 12, 2013, which is hereby incorporated by reference herein in its entirety.

What is claimed is:

1. An image forming apparatus capable of executing a double-sided mode in which images are formed on both sides of a sheet, comprising:

a sheet feeding unit configured to feed a sheet;

an image forming unit configured to form images on the sheet fed from said sheet feeding unit;

a sheet inverting unit configured to invert the sheet, on which an image has been formed on a first side thereof by said image forming unit, in the double-sided mode;

a sheet discharge tray onto which the sheet on which the mage has been formed by said image forming unit is discharged;

a switching unit configured to switch a conveyance destination for the sheet to a first conveying path leading toward said sheet inverting unit or a second conveying path leading to said sheet discharge tray;

a detection unit configured to detect a length of the sheet, which is fed from said sheet feeding unit, in a conveying direction while the sheet is being conveyed; and a control unit configured to, when a size of the sheet has not been undetermined and the length of the sheet in the conveying direction is not detected by said detection unit by the time the sheet reaches said switching unit in the double-sided mode, control said switching unit so that the sheet with the image formed on the first side thereof can be conveyed to the second conveying path, wherein said control unit controls said switching unit so that the sheet is conveyed to the first conveying path when the length of the sheet in the conveying direction detected by said detection unit lies inside a predetermined range, and the sheet is conveyed to the second conveying path when the length of the sheet in the conveying direction detected by said detection unit falls outside the predetermined range.

2. The image forming apparatus according to claim 1, wherein an upper limit to the predetermined range is set at such a maximum length of the sheet that the sheet can be inverted by said sheet inverting unit.

3. The image forming apparatus according to claim 1, further comprising a plurality of conveying rollers configured to convey the sheet, and wherein a lower limit to the predetermined range is set to be longer than a longest distance among distances between converting rollers, which are placed on a conveying path leading from the first conveying path back to said image forming unit via said sheet inverting unit, among said plurality of conveying rollers.

4. The image forming apparatus according to claim 1, wherein said detection unit comprises a sensor that detects the presence or absence of the sheet and detects the length of the sheet based on an output from the sheet during conveyance of the sheet, and said control unit controls, when the rear end of the sheet has not passed the sensor by the time the sheet reaches said switching unit, said switching unit so that the sheet can be conveyed to the second conveying path.

5. The image forming apparatus according to claim 1, wherein said detection unit detects the length of the sheet in the conveying direction based on a time period required for a trailing end of the sheet fed from said sheet feeding unit to pass a predetermined position ahead of said switching unit after a leading end of the sheet passes the predetermined position.

6. The image forming apparatus according to claim 1, wherein said control unit controls said switching unit based on the detection result by said detection unit when a size of the sheet is undetermined at a time at which the sheet is fed by said sheet feeding unit.

7. An image forming capable of executing a double-sided mode in which images are formed on both sides of a sheet, comprising:

a sheet feeding unit configured to feed a sheet;

an image forming unit configured to form images on the sheet fed from said sheet feeding unit;

a sheet inverting unit configured to invert the sheet, on which an image has been formed on a first side thereof by said image forming unit, in the double-sided mode;

a sheet discharge tray onto which the sheet on which the mage has been formed by said image forming unit is discharged;

a switching unit configured to switch a conveyance destination for the sheet to a first conveying path leading toward said sheet inverting unit or a second conveying path leading to said sheet discharge tray;

a detection unit configured to detect a length of the sheet, which is fed from said sheet feeding unit, in a conveying direction while the sheet is being conveyed;

a notification unit configured to notify information;

an input unit configured to receive an input of a size of the sheet before the sheet is fed from said sheet feeding unit; and a control unit configured to, when a size of the sheet has not been undetermined and the length of the sheet in the conveying direction is not detected by said detection unit by the time the sheet reaches said switching unit in the double-sided mode, control said switching unit so that the sheet with the image formed on the first side thereof can be conveyed to the second conveying path, wherein said control unit causes, before image formation on the sheet, which is fed from said sheet feeding unit, in the double-sided mode is started with a size of the sheet undetermined, said notification unit to provide notification of a possibility that the double-sided mode cannot be executed, and wherein said control unit causes said notification unit to provide notification of a possibility that the double-sided mode cannot be executed and notification to prompt an input of a size of the sheet by the input unit.

8. An image forming apparatus capable of executing a double-sided mode in which images are formed on both sides of a sheet, comprising:

a sheet feeding unit configured to feed a sheet;

an image forming unit configured to form images on the sheet fed from said sheet feeding unit;

a sheet inverting unit configured to invert the sheet, on which an image has been formed on a first side thereof by said image forming unit, in the double-sided mode;

a sheet discharge tray onto which the sheet on which the mage has been formed by said image forming unit is discharged;

a switching unit configured to switch a conveyance destination for the sheet to a first conveying path leading toward said sheet inverting unit or a second conveying path leading to said sheet discharge tray;

a detection unit configured to detect a length of the sheet, which is fed from said sheet feeding unit, in a conveying direction while the sheet is being conveyed;

an input unit configured to receive an input of a size of the sheet before the sheet is fed from said sheet feeding unit; and a control unit configured to, when a size of the sheet has not been undetermined and the length of the sheet in the conveying direction is not detected by said detection unit by the time the sheet reaches said switching unit in the double-sided mode, control said switching unit so that the sheet with the image formed on the first side thereof can be conveyed to the second conveying path, wherein in a case where a size of the sheet is input by said input unit in the double-sided mode, said control unit selects the first conveying path or the second conveying path as a conveying path on which the sheet is to be conveyed based on the size of the sheet input by said input unit and provides control to convey the sheet to the selected conveying path.

* * * * *